US005160058A

United States Patent [19]

Ahn

[11] Patent Number: 5,160,058

[45] Date of Patent: Nov. 3, 1992

[54] BEVERAGE BOTTLE WITH FLOATING STRAW

[75] Inventor: Si Y. Ahn, 221-06 58th Ave., Bayside, N.Y. 11364

[73] Assignee: Si Y. Ahn, Bayside, N.Y.

[21] Appl. No.: 717,990

[22] Filed: Jun. 20, 1991

[51] Int. Cl.[5] ..... A47G 19/22; A47G 21/18; B65D 83/00

[52] U.S. Cl. ..... 215/1 A; 220/706; 220/710; 229/103.1

[58] Field of Search ..... 215/1 A; 229/103.1; 220/705-710

[56] References Cited

U.S. PATENT DOCUMENTS

| | | | |
|---|---|---|---|
| 1,309,994 | 7/1919 | McAuliffe | 215/1 A |
| 2,837,234 | 6/1958 | Mainiere | 229/103.1 X |
| 3,099,565 | 7/1963 | Neuhauser | 215/1 A X |
| 3,106,312 | 10/1963 | Hitchcock | 215/1 A |
| 3,291,331 | 12/1966 | Grisham | 215/1 A |
| 3,326,695 | 6/1967 | Neuhauser | 215/1 A X |
| 3,776,458 | 12/1973 | Chunga | 215/1 A X |
| 4,424,913 | 1/1984 | Ko | 215/1 A X |
| 4,733,785 | 3/1988 | Turner, Jr. et al | 215/1 A X |
| 4,877,148 | 10/1989 | Larson et al. | 215/1 A X |
| 4,892,187 | 1/1990 | Stein | 215/1 A X |

FOREIGN PATENT DOCUMENTS

| | | | |
|---|---|---|---|
| 2106121 | 10/1971 | Fed. Rep. of Germany | 215/1 A |
| 2532678 | 2/1976 | Fed. Rep. of Germany | 215/1 A |
| 1091935 | 4/1955 | France | 215/1 A |
| 1015430 | 12/1965 | United Kingdom | 215/1 A |

*Primary Examiner*—Sue A. Weaver

[57] ABSTRACT

A drinking straw contained in a bottle having a flexible portion (3), a floating ball (2), a ring (4), and a washer (5). When the cap is opened, the straw comes up immediately to an ideal drinking position and the user does not have to use his/her fingers to hold it. This convenient and safe way of drinking beverages will make any drinking experience a pleasurable one.

5 Claims, 3 Drawing Sheets

BEVERAGE BOTTLE WITH FLOATING STRAW

BACKGROUND

1. FIELD OF INVENTION

This invention relates to beverage bottles, specifically to facilitate drinking through a straw already contained in the bottle.

2. DESCRIPTION OF PRIOR ART

Beverages contained in bottles present some inconvenience. Since most people like to drink them using a straw and straws don't come with the beverage, consumers are required to ask for straws or often to buy them separately. Furthermore, since they come in individual wraps one is required to use his/her fingers to tear off the protective wrap and insert the straw in the bottle. This process of touching the straw could be unhealthy if the person drinking it does not have a properly washed hand.

Some bottles for example, come with top closures or caps made of metal that sometimes rust leaving the neck of the bottle with deposits of rust and if one sips directly from it an unhealthy situation could be created.

On the other hand, my invention combines convenience and hygiene at the same time. Since the floating straw is not required to be held by fingers, one will be able to drink his/her beverage safely in a clean way without being worried even if his/her hands are not clean.

Many inventions were conceived and patented in this field:

| Patent No. | Patentee | Issue Date |
|---|---|---|
| 2,837,234 | Mainiere | 6/03/58 |
| 3,099,565 | Neuhauser | 7/30/63 |
| 3,326,695 | Neuhauser | 6/20/67 |
| 3,291,331 | Grisham | 12/13/66 |
| 3,776,458 | Chunga | 12/04/73 |

Mainiere discloses a straw in a bottle, but his invention requires the design of the cap to be changed making bottle producers spend extra money for the design and besides, his designs are for caps that are not in extensive use nowadays. The simple and plain straw used by Mainiere will not come up fast if the level of the liquid goes down.

Neuhauser U.S. Pat. No. 3,099,565 discloses a bell shaped cone attached to the straw downwardly, with the straw being raised by the cone capturing the gases liberated from the effervescence of the beverage. This invention if used with non-effervescent beverages will not work. Furthermore, if the level of the liquid goes down and the beverage has liberated most of its gases the straw will not come up easily.

Neuhauser U.S. Pat. No. 3,326,695 discloses a similar bell shaped cone as in his U.S. Pat. No. 3,099,565 and for the same reasons the straw will not come up easily if the beverage is non-effervescent or if the level of the liquid goes down. The straw in this invention is coated with a soluble material which presents extra costs to the manufacturers.

Grisham U.S. Pat. No. 3,291,331 discloses a pop-up straw for bottles with an "invaginable portion" (as mentioned by him in his specification) that upon opening the cap, it forces the straw to come up by pressure. This invention is complicated and costly for just a drinking experience, and besides it does not give the drinker the option of drinking directly from the bottle (without the straw) if he/she wants to.

Chunga U.S. Pat. No. 3,776,458 discloses the most complicated of all inventions in this field. It uses a coil spring to extend a telescopic straw when the cap of the bottle is opened. This apparatus is too complicated and costly, therefore not viable to be used commercially.

While the patents listed above present straws contained in a bottle, none of the above patents presents a floating ball or a buoy to raise the straw to a drinking position. A floating ball raises the straw more rapidly and efficiently than others even when the level of the liquid is low and it does not matter if the beverage is carbonated or not. The straw has a flexible portion to give the drinker a better drinking position.

Compared to other inventions in this field, The Beverage Bottle With Floating Straw is the most inexpensive and reliable one. Consisting of a flexible portion, a floating ball, a ring, a washer, and a straw guide that guides the straw accurately to the opening of the bottle, it is simple enough to give consumers a safe and a pleasurable drinking experience.

DRAWING FIGURES

FIG. 1 is a perspective view of the straw containing a flexible portion, a floating ball, a ring, and a washer.

FIG. 2 is a detailed view of a portion of the straw, showing the ring and the washer.

FIG. 3 is a perspective view of the straw guide.

FIG. 4 is a perspective side view of the straw guide in FIG. 3.

FIG. 5 is a cross sectional view of the bottle with the straw guide.

FIG. 6 is a cross sectional view of the bottle with the straw guide and the straw attached to the straw guide.

FIG. 7 is a cross sectional view of the final product without the cap.

FIG. 8 is cross sectional view of the final product.

FIG. 9 is a cross sectional view of the invention with the cap off and straw up, ready to drink.

FIG. 10 is a cross sectional view of the invention with the straw straightened to reach the beverage when the level of the beverage goes down.

FIG. 11 is a perspective view of a different straw guide.

FIG. 12 is a cross sectional view of another design of the neck of the bottle.

FIG. 13 is a cross sectional view of the bottle in FIG. 12 with a C-clamp attached to it.

FIG. 14 is a cross sectional view of the bottle in FIG. 13 with the straw held by C-clamp.

| Reference Numerals in Drawings |
|---|
| 1. straw |
| 2. floating ball or buoy |
| 3. flexible portion |
| 4. ring |
| 5. washer |
| 6. straw guide rim |
| 7. straw guide |
| 8. C-clamp (1) |
| 9. bottle |
| 10. liquid surface |
| 11. beverage |
| 12. bottle cap |
| 13A. flexible straw guide |
| 13B. C-clamp (2) |
| 14. slot |

-continued

| Reference Numerals in Drawings |
| --- |
| 15. C-clamp (3) |

DESCRIPTION OF FIGURES

FIG. 11 discloses another design of the bottle 9. The inside of the neck of it has a slot 4, which houses the C-clamp(3) 15 as FIG. 13 shows.

OPERATION

Figure 1:
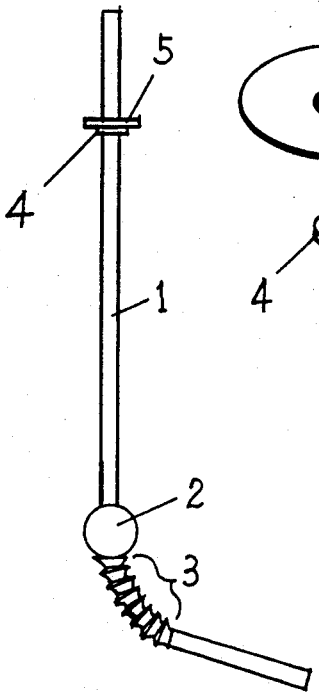
FIG. 1 discloses the straw with a flexible portion 3, a buoy 2, a ring 4, and a washer 5. The ring 4 is secured around the straw (or it could be a radial projection of the straw) to hold the washer 5 from going down.
Figure 2:
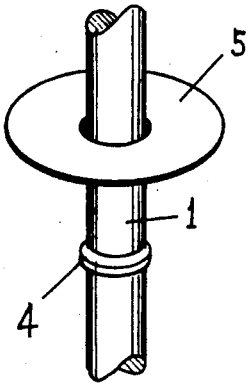
FIG. 2 discloses a portion of the straw 1 showing in details the washer 5 and the ring 4. The washer 5 should be made of a material that dissolves slowly with water, it can be sugar based or any other suitable material.
Figure 3:
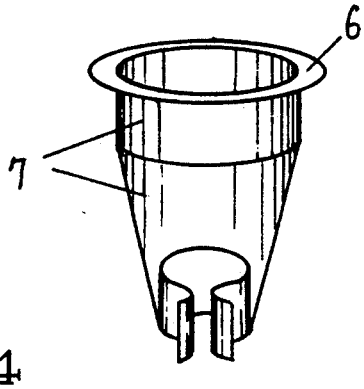
FIG. 3 discloses the straw guide 7 with a C-clamp 8 attached to the bottom portion of it. The straw guide resembles a cylindric tube with a part of it cut longitudinally having a rim 6 projected outwardly on its top portion and a C-clamp on its bottom portion.
Figure 4:
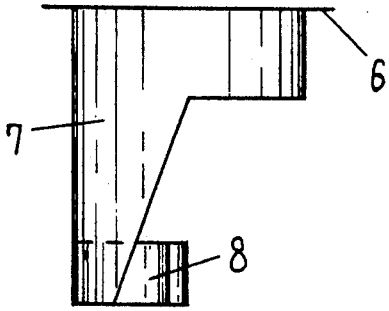
Figure 5:
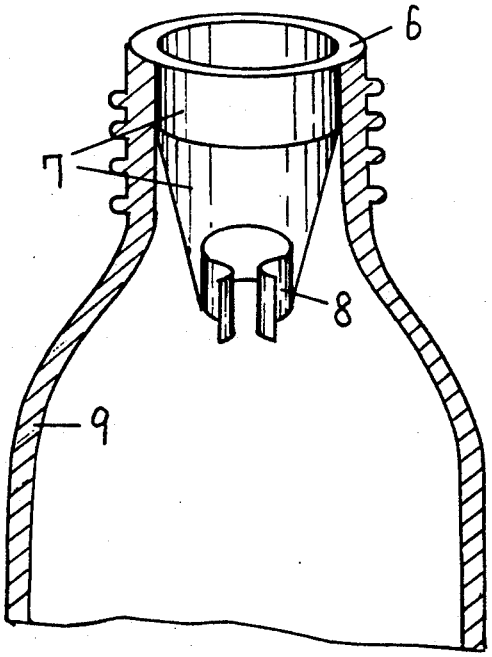
Figure 6:
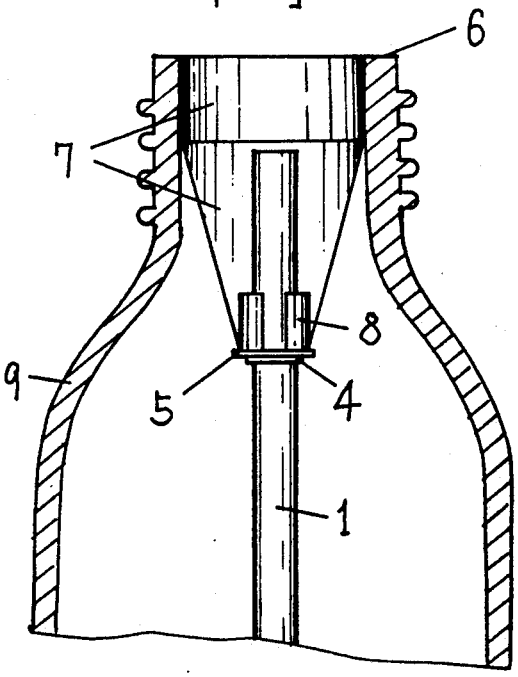
FIG. 6 discloses the beverage bottle 9 with the straw guide 7 and the straw 1 all in their respective places. The diameter of washer 5 should be larger than C-clamp 8's, so that when the beverage is poured (FIG. 7), the straw does not come up immediately because washer 5 is holding it against C-clamp 8. Washer 5 should dissolve completely only after the cap is put on the bottle as FIG. 8 shows.
Figure 7:
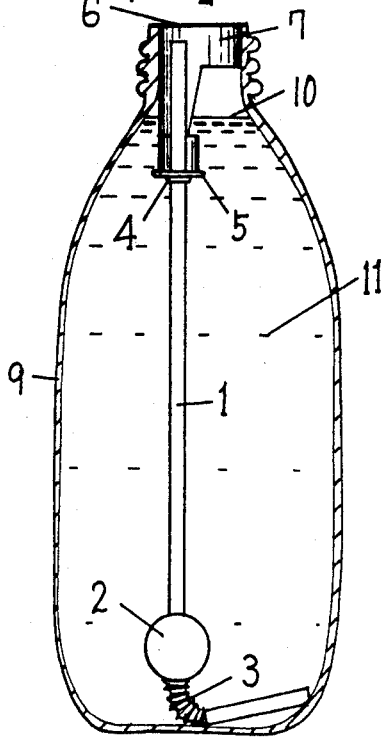
FIG. 7 discloses the bottle 9 with the straw and straw guide 7 in place, note that the washer 5 has not yet dissolved, therefore holding the straw against the C-clamp 8 and not letting it float up. Reference numeral 10 is the surface of the liquid and 11 is the beverage.
Figure 8:
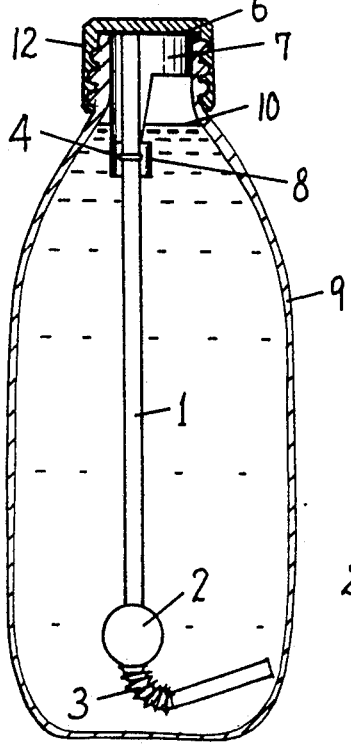
In FIG. 8 washer 5 has already dissolved and the only thing blocking the straw from floating up is the cap 12, at this moment the straw is right underneath the cap waiting to come up.
Figure 9:
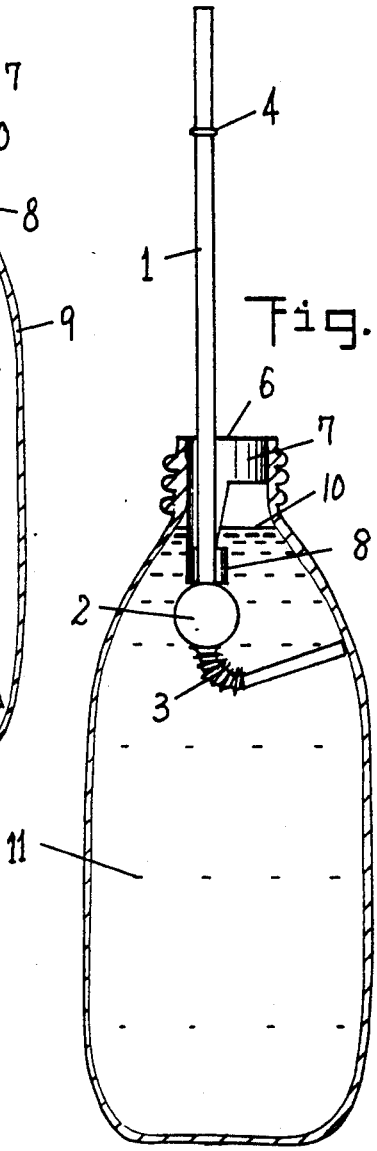
FIG. 9 discloses the bottle 9 with the cap 12 off and the straw is out, ready to be consumed.
Figure 10:
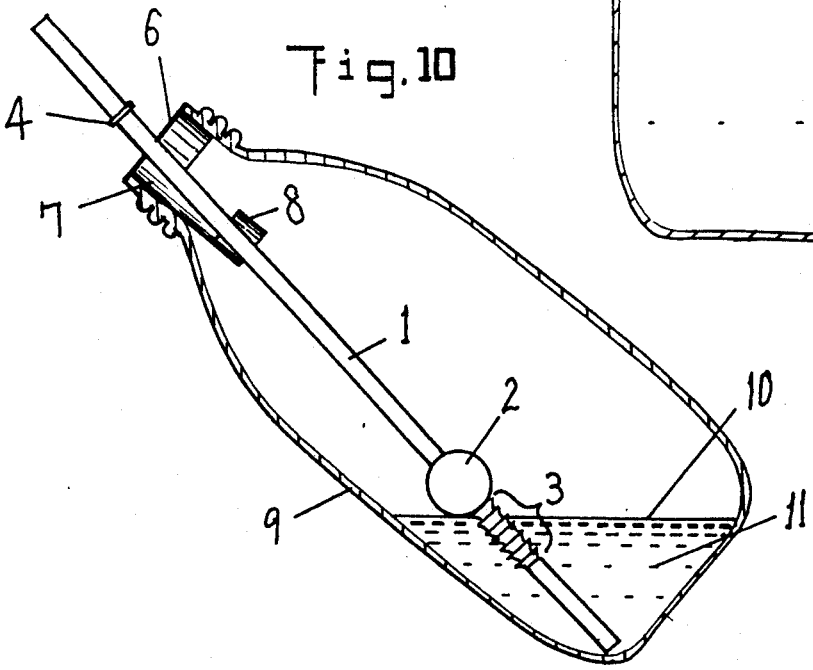
FIG. 10 shows the same bottle as in FIG. 9 with the level 10 of the liquid 11 down and straw 1 is straightened to reach the bottom of the bottle.
Figure 11:
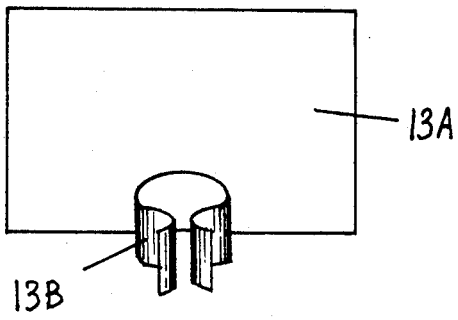
FIG. 11 discloses the straw guide 13A with C-clamp(2) 13B, which another design of the straw guide of FIG. 3. It is a rectangular or square flexible sheet of plastic or any other suitable material that when rolled and fitted internally around the neck of the bottle, it will stay tightly in place.
Figure 12:
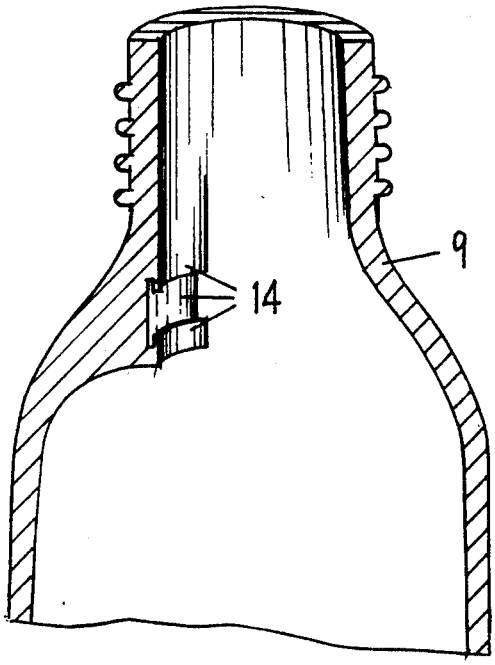
Figure 13:
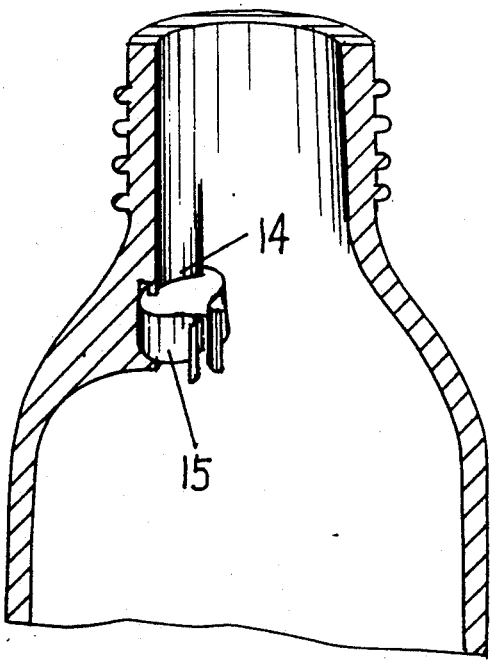
Figure 14:
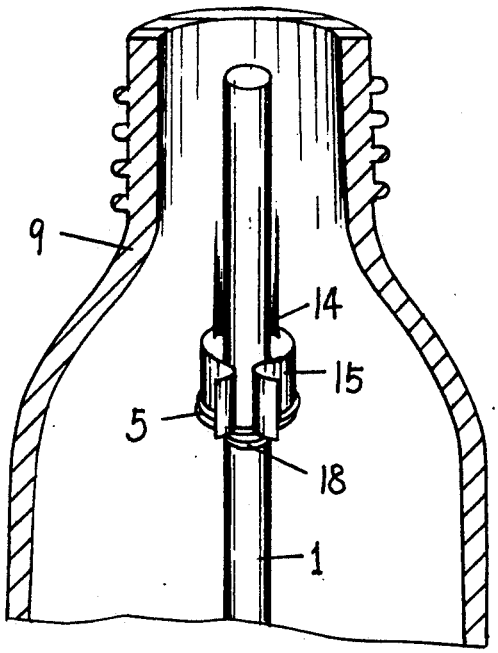

The manner of using the Floating Straw For Beverage Bottles is very simple. Consumers will buy the final product like the one illustrated in FIG. 8. All he/she has to do is open the bottle by taking off the cap 12, at that very moment the straw 1 will come up immediately to an ideal drinking position as FIG. 9 shows.

When the level of the liquid goes down as it is being drunk, straw 1 can be straightened to be able to reach the bottom of the bottle 9.

SUMMARY, RAMIFICATIONS, AND SCOPE

According, the reader will see that the floating straw of this invention provides consumers an easy and convenient way to drink from a beverage bottle. Furthermore, the Floating Straw For Beverage Bottles has additional advantages in that:

- it permits consumers to drink beverages without their fingers ever touching the straw;
- it provides a floating straw that comes up to an ideal drinking position accurately and reliably every time the bottle is opened;
- it provides a straw containing a flexible portion, a buoy, a ring, and a washer that dissolves slowly when in contact with water.

Although the description above contains many specificities, these should not be construed as limiting the scope of the invention but as merely providing illustrations of some of the presently preferred embodiments of this invention. For example, the buoy can have other shapes: oval, etc.

Thus the scope of the invention should be determined by the appended claims, rather than by examples given.

What I claim is:

1. In combination, a beverage bottle with a neck and containing:

(a) a straw having a flexible portion, (b) a float made of a material of a lesser specific gravity than water and means securing the float about the straw so that the upper portion of the straw will be raised above the bottle neck when the bottle is opened;

(c) a washer that is made of a material that dissolves slowly when in contact with water, the washer being dimensioned to be received about an upper portion of the straw;

(d) a ring defining a circular transversal projection fixed around the straw and dimensioned and disposed below the washer to prevent the washer from moving down said straw; and (e) a straw guide means including a C-shaped clamp, said straw guide means dimensioned to be secured internally in said bottle neck and said C-shaped clamp being of a dimension smaller than the washer and larger than said ring and being disposed about the straw above the washer so as to hold the straw within the bottle while the bottle is being filled.

2. The combination as claimed in claim 1, wherein the washer is formed of a sugar based material which dissolves after the bottle is opened by the consumer.

3. The combination as claimed in claim 1, wherein the straw guide means includes a transverse slot internally on the bottle neck and said C-shaped clamp includes means for securement in said slot.

4. The combination as claimed in claim 1, wherein the straw guide means includes a cylindrical sleeve with an upper and lower end dimensioned to be retained in the bottle neck with said C-shaped clamp being disposed at said lower end of the sleeve, towards the interior of the bottle.

5. The combination as claimed in claim 4, wherein said sleeve includes a radially, outwardly directed flange disposed at its upper end, said flange being dimensioned to rest on the end of the bottle neck.

* * * * *